United States Patent [19]

Krawczak

[11] Patent Number: 4,725,378

[45] Date of Patent: Feb. 16, 1988

[54] SYSTEMS FOR DELAYED RELEASE OF BLEACHING AGENTS

[75] Inventor: Dawn T. Krawczak, Midland, Mich.

[73] Assignee: The Dow Chemical Company, Midland, Mich.

[21] Appl. No.: 605,344

[22] Filed: Apr. 30, 1984

Related U.S. Application Data

[63] Continuation of Ser. No. 360,284, Mar. 22, 1982, abandoned.

[51] Int. Cl.[4] ..... C11D 3/37; C11D 3/395; C11D 11/00; D06L 3/06

[52] U.S. Cl. ..... 252/186.35; 252/95; 252/102; 252/174; 252/174.13; 252/174.21; 252/174.23; 252/174.25; 252/186.23; 252/186.34; 252/186.36; 252/187.24; 252/187.25; 252/187.34

[58] Field of Search ..... 252/95, 102, 174, 174.13, 252/174.24, 174.21, 174.23, 186.25, 186.34, 186.35, 186.36, DIG. 3, 187.24, 187.25, 187.34

[56] References Cited

U.S. PATENT DOCUMENTS

| | | | |
|---|---|---|---|
| 3,042,621 | 7/1962 | Kirschenbauer | 252/99 |
| 3,330,885 | 7/1967 | Dalton | 260/878 |
| 3,387,061 | 6/1968 | Smith | 260/874 |
| 3,741,911 | 6/1973 | Shane | 252/527 |
| 3,843,585 | 10/1974 | Kangas | 260/29.7 N |
| 3,908,045 | 9/1975 | Alterman | 427/213 |
| 3,944,497 | 3/1976 | Alterman | 252/96 |
| 3,950,296 | 4/1976 | Kangas | 260/29.6 N |
| 3,975,280 | 8/1976 | Hachmann | 252/102 |
| 3,983,254 | 9/1976 | Alterman | 428/403 |
| 3,992,317 | 11/1976 | Brichard | 252/95 |
| 4,078,099 | 3/1978 | Mazzola | 427/213 |
| 4,090,973 | 5/1978 | Maguire | 252/174 |
| 4,124,734 | 11/1978 | Alterman | 428/403 |
| 4,136,052 | 1/1979 | Mazzola | 252/94 |
| 4,211,688 | 7/1980 | Alterman | 524/100 |
| 4,234,442 | 11/1980 | Cornelissens | 252/90 |
| 4,419,260 | 12/1983 | Reuter | 252/174.13 |

FOREIGN PATENT DOCUMENTS 1509797 5/1978 United Kingdom .

OTHER PUBLICATIONS

Journal of Polymer Science: Polymer Chemistry Edition, vol. 17, pp. 3485–3498.
W. Germany (Derwent 68406t).
Chemical Abstracts 90:56750v.
Chemical Abstracts 87:186417r.
Chemical Abstracts 84:152645m.
Chemical Abstracts 80:96462c.
Chemical Abstracts 73:56505t.
Chemical Abstracts 47:6311c.

*Primary Examiner*—Dennis Albrecht
*Attorney, Agent, or Firm*—Paul D. Hayhurst

[57] ABSTRACT

Novel compositions useful in supplying bleach over a period of time are produced by contacting a polycarboxylic acid, a second polymeric compound, and a chlorine-releasing agent under the proper conditions.

20 Claims, No Drawings

SYSTEMS FOR DELAYED RELEASE OF BLEACHING AGENTS

CROSS-REFERENCE TO RELATED APPLICATION

This is a continuation of application Ser. No. 360,284, filed Mar. 22, 1982, now abandoned.

BACKGROUND OF THE INVENTION

This invention relates to compositions of matter which are useful for delivering a substance into a liquid medium over a period of time after a delay period. It further relates to methods of making these compositions. More specifically, the present invention concerns compositions which contain polymeric association products and which delay the release of chlorine-containing compounds in liquid environments.

The incompatibility of chlorine-releasing substances with other materials used in laundering, e.g., enzymes and brighteners, is a problem long recognized in the art. Generally, the premature presence of a free bleaching agent in wash water renders ineffective many compounds which otherwise would have a beneficial effect on the laundering process. Thus, for some applications, chlorine-releasing substances must not be added until the materials which are incompatible with chlorine have satisfactorily accomplished their tasks.

Several methods of, and compositions for, delaying the release of chlorine in laundry applications are known. For example, a process wherein chlorine bleaches are microencapsulated in a fatty acid by means of a fluidized bed is described in U.S. Pat. No. 4,124,734. Heretofore, however, a composition which contains the polymeric association products of the instant invention and which delays the release of chlorine into aqueous solutions without employing microencapsulation technology has not been disclosed, nor has there been a revelation of a process for making such a composition.

SUMMARY

In one aspect, this invention is a number of novel compositions which contain:

(a) a polymeric association product of a polycarboxylic acid and a second polymeric compound; and (b) a chlorine-releasing agent.

Surprisingly, these compositions provide an effective delayed release of chlorine bleach without relying on microencapsulation techniques. In another aspect, this inventon is a process for preparing the aforementioned novel compositions. The process of the present invention involves contacting a polycarboxylic acid, a second polymeric compound, and a chlorine-releasing agent under conditions such that a novel composition, as hereinbefore described, is obtained.

The compositions of this invention are useful in applications which call for the delayed release of chlorine bleaching agents. Exemplary of this utility is the use of these compositions in formulations which contain compounds whose effectiveness is diminished by the presence of chlorine. For example, some compounds which are useful in detergent systems are rendered ineffective by the presence of chlorine. Thus, it is advantageous to delay the release of bleach until the chlorine-sensitive components have been afforded sufficient time to complete their function, be it whitening, brightening, cleaning or otherwise. The compositions of the present invention provide chlorine-sensitive compounds with the time they need before releasing chlorine in amounts deleterious to the action of the chlorine-sensitive compounds. In detergent systems, the use of these compositions obviates the need to add chlorine bleach in a separate step or in pouch form, which form is inflexible with respect to applications which call for varying amounts of bleach.

DETAILED DESCRIPTION OF THE INVENTION

The chlorine-releasing agent of this invention may be one or a combination of a number of known chlorine-releasing compounds. Typical chlorine-releasing agents include those oxidants capable of having their chlorine liberated in the form of free elemental chlorine under conditions normally used for detergent bleaching purposes, such as potassium dichloroisocyanurate, sodium dichloroisocyanurate, trichloroisocyanurate, chlorinated trisodium phosphate, calcium hypochlorite, lithium hypochlorite, monochloramine, dichloramine, nitrogen trichloride, a complex of trichloroisocyanurate and potassium dichloroisocyanurate wherein the molar ratio of the former to the latter is approximately one to four, 1,3-dichloro-5,5-dimethyl hydantoin, para-toluene sulfondichloramide, trichloromelamine, N-chloromelamine, N-chlorosuccinimide, N,N'-dichloroazodicarbonamide, N-chloro acetyl urea, N,N'-dichlorobiuret, chlorinated dicyandiamide, trichlorocyanuric acid, dichloroglycoluril, and combinations of these compounds. Preferred chlorine-releasing agents include a complex of trichloroisocyanurate and potassium dichloroisocyanurate, wherein the molar ratio of the former to the latter is approximately one to four, potassium dichloroisocyanurate, sodium dichloroisocyanurate, and trichloroisocyanurate.

Typically, the novel compositions of the present invention contain from about 0.3 to about 3 parts, on a weight basis, of chlorine-releasing agent per part of polymeric association product. Preferably, this will range from about 0.3 to about 1 parts of chlorine-releasing agent per part polymeric association product.

For the purposes of the present invention, the term "second polymeric compound" refers to those compounds which, when combined in solution or suspension with an appropriate polycarboxylic acid, will form a polymeric association product under the proper conditions. Second polymeric compounds may be water-soluble and are selected so that at room temperature and under proper conditions, as are hereinafter described, they will readily form polymeric association products which precipitate out of an aqueous solution. Essentially any polymer system which is capable of forming either inter- or intramolecular hydrogen bonds is a suitable second polymeric compound. Examples of suitable second polymeric compounds include, for example, poly(vinyl pyrrolidone), polyacrylamide, copolymers of ethylene glycol and propylene glycol, and copolymers of maleic anhydride and ethylene. Further examples of suitable second polymeric compounds are found in U.S. Pat. No. 3,387,061. Polyethers, polyamines and polyamides are preferred second polymeric compounds. Examples of more preferred second polymeric compounds are poly(ethyl oxazoline), poly(ethylene glycol) having a weight average molecular weight of from about 600 to about 6,000, and poly(vinyl pyrrolidone). Examples of most preferred second polymeric compounds include poly(ethylene glycol) having a weight average molecular weight of from about 1,400 to about 4,000 and poly(ethyl oxazoline) having a weight average molecular weight of about 50,000.

The polycarboxylic acids, also referred to herein as polyacids, of this invention are those acidic polymeric compounds in which the acidity is due to two or more free carboxyl groups. Suitable polyacids are those which are capable of forming cooperative interactions or bindings with the second polymeric compounds of the present invention. For a reference to the term "cooperative interactions or bindings" see *Journal of Polymer Science:Polymer Chemistry Edition,* Vol. 17, pp. 3485–3498. These polyacids typically contain an average of from about 0.7 to about 1.2 free carboxyl groups per 100 molecular weight. The average molecular weight, as determined by the solution viscosity method, of suitable polyacids ranges to from about 50,000 to about 500,000 and higher. Some typical polycarboxylic acids are described in U.S. Pat. No. 3,387,061. Poly(methacrylic acid) and poly(acrylic acid) are examples of preferred polyacids.

An inert solvent is advantageously employed in the process of this invention. For the purposes of this invention, an inert solvent is a solvent which does not detract from the efficacy of the product-forming process. The solvent serves to solubilize the ingredients which form the final product, thereby facilitating their association. The amount of solvent to be employed is indicated by practical considerations, but enough should be used to solubilize the ingredients involved. Tvpically, a polymer solution with a concentration of from about 0.8 weight percent to about 4.5 weight percent is employed. Examples of suitable inert solvents include methanol, dimethylformamide, β-methoxyethanol, ethanol, isopropanol, and other polar solvents, but, as previously noted, water is generally the preferred solvent.

The polymeric association products of this invention are water-insoluble complexes which can be best described as arising from one or more diverse mechanisms such as hydrogen bonding, electrostatic bonding, hydrophobic interactions, valence forces and the like. Several suitable polymeric association products and methods of making them are described in U.S. Pat. No. 3,387,061, the teachings of which are herein incorporated by reference.

Examples of preferred polymeric association products are those which are formed between poly(acrylic acid) and poly(ethylene glycol); and between poly(methacrylic acid) and poly(ethylene glycol). More preferred polymeric association products are formed between poly(acrylic acid) and poly(ethyl oxazoline). The most preferred polymeric association products are formed between poly(methacrylic acid) and poly(ethyl oxazoline).

The process and the resulting association products, in their broad aspects, involve contacting the indicated polyether, polyacid and chlorine-releasing agent under conditions and subsequent treatment such that a water-insoluble association product is produced. The delayed-release bleaching compositions of this invention are typically formed by adding one or more of the aforementioned second polymeric compounds to a solution of a polyacid to form a polymeric mixture, which has a pH as is hereinafter specified, and which contains about 1 mole of polyacid per mole of second polymeric compound. Since the vast majority of the polyacids and second polymeric compounds contemplated in the instant invention are water-soluble compounds, the contacting of the polyacid component and second polymeric compound component can be effected by dissolving these components, in the desired concentration, in an aqueous medium. It is preferred to dissolve the components separately in water, in the desired concentration, and subsequently to add one solution to the other. The resulting mixture is cooled and one or more of the aforementioned chlorine-releasing agents are then added to the polymeric mixture.

The chlorine-containing polymeric mixture is then acidified slowly until precipitation of the product ceases. It has been observed that the components of the mixture will generally remain in solution at room temperature when the pH of the solution is above about 3.5. Lowering the pH below about 3.5, and preferably below about 3.0, generally results in the formation of a precipitate, i.e., an association product, within seconds or almost immediately. When the pH is decreased to about 2.0 or lower, precipitation of the association product is usually virtually complete. The rate of precipitation is unusually pronounced as the molar ratio of free carboxylic groups from the polyacid to functional groups from the second polymeric compound approaches 1.0. The precipitate may be recovered using any desirable means, including known methods of filtering, washing or rinsing, and drying. For example, the precipitate may be washed with deionized water, filtered on filter paper, and dried using a vacuum oven at ambient temperature.

The medium or solvent in which the two polymeric components are contacted typically has a pH, measured after the two polymeric components have been added to the medium, of about 3.5 or higher. Preferably, the pH of the medium is from about 6 to about 8. More preferably, the pH is from about 6.8 to about 7.2.

It should also be noted that when the polyacid component or second polymeric compound component is substantially water-insoluble, e.g., beta-carboxyethyl silicone polymer, poly(vinyl ethyl ether), and the like, the reaction can be conducted by first dispersing the water-insoluble component as a finely divided suspension in aqueous medium, and then mixing the resulting aqueous suspension with an aqueous solution or suspension containing the other component in the manner noted previously.

The two polymeric components may be contacted at any temperature at which both components are in solution or suspension. Typically, the temperature at which the components are contacted is between about 0° C. and about 25° C. Preferably, the temperature will be from about 5° C. to about 10° C. Ordinarily, the process is conducted at atmospheric pressure, but sub- or superatmospheric pressures can be employed if desired.

The following examples are given to illustrate the present invention and should not be construed as limiting its scope. All parts and percentages are by weight unless otherwise indicated.

EXAMPLE 1

To a 600-ml glass beaker is added 200 ml of a 0.87 percent solution of poly(methacrylic acid), which then is neutralized with 10 percent KOH to a pH of 7.0. To this neutralized solution is added 200 ml of a 1.98 percent solution of poly(ethyl oxazoline). This mixture is stirred until it becomes homogeneous. The beaker is then inserted into an ice bath to cool the mixture to approximately 0° C. A chlorine-releasing agent is charged into the mixture with stirring. The system is then acidified by dropwise addition of 1.0N HCl until no further precipitation occurs (pH 3.5–3.0). This precipitate is filtered, washed with deionized water, and is dried overnight in a vacuum oven at ambient temperature. The precipitate is white, has a powdery appearance, and is somewhat brittle in texture.

EXAMPLE 2

A composition is prepared using the method of Example 1. The chlorine-releasing agent is trichloroisocyanurate, and three-tenths of a part of it is added to the cooled, homogeneous solution for every part of polymeric association product. A 0.5-g sample of this composition is added with stirring to an Erlenmeyer flask, which contains approximately 200 ml of distilled water, and is allowed to dissolve. At time intervals of 1, 2, 3, 4, 5, 10 and 30 minutes, aliquots (10 ml each) are removed from the flask and are transferred to a beaker containing 25.0 ml of deionized water, 5.0 ml of a 3 percent solution of potassium iodide, 5.0 ml of concentrated $H_2SO_4$, and 5.0 ml of starch indicator. The contents of each beaker are titrated, using a standard iodometric titration method for determination of halogen concentration, to the endpoint with a 0.01N solution of $Na_2S_2O_3$. The following results are obtained:

| Elapsed Time (min.) | Chlorine Released (mg chlorine/-mg of solution) |
|---|---|
| 1 | $1.6 \times 10^{-3}$ |
| 2 | $2.1 \times 10^{-3}$ |
| 3 | $3.9 \times 10^{-3}$ |
| 4 | $4.3 \times 10^{-3}$ |
| 5 | $5.3 \times 10^{-3}$ |
| 10 | $5.9 \times 10^{-3}$ |
| 30 | $9.5 \times 10^{-3}$ |

EXAMPLE 3

The procedure of Example 2 is repeated with different compositions and the following results are obtained:

| | | | Chlorine Released (mg chlorine/mg solution) at Elapsed Time | | |
|---|---|---|---|---|---|
| Ex. | Comp.* | PCR** | 1 min | 5 min | 10 min |
| 3a | PAA/PEOX | 3.0 | $3.4 \times 10^{-3}$ | $2.4 \times 10^{-2}$ | $2.7 \times 10^{-2}$ |
| 3b | PAA/PEOX | 1.0 | $2.9 \times 10^{-4}$ | $7.6 \times 10^{-3}$ | $1.0 \times 10^{-2}$ |
| 3c | PMA/PEG | 0.3 | $3.5 \times 10^{-2}$ | $5.1 \times 10^{-2}$ | $6.5 \times 10^{-2}$ |
| 3d | PMA/PEG | 1.0 | $5.5 \times 10^{-3}$ | $8.0 \times 10^{-3}$ | $9.2 \times 10^{-3}$ |
| 3e | PMA/PEOX | 0.3 | $9.2 \times 10^{-3}$ | $1.4 \times 10^{-2}$ | $1.9 \times 10^{-2}$ |

*Composition abbreviations:
PAA = poly(acrylic acid) having a viscosity average molecular weight of 150,000–200,000.
PMA = poly(methacrylic acid) having a viscosity average molecular weight of 25,000–50,000.
PEG = poly(ethylene glycol) having a number average molecular weight of 4,000.
PEOX = poly(ethyl oxazoline) having a number average molecular weight of 50,000.
**PCR = Parts chlorine-releasing agent per part of association product.

Examples 3a, 3b and 3c all use a complex of trichloroisocyanurate and potassium dichloroisocyanurate, wherein the molar ratio of the former to the latter is approximately 1 to 4, as the chlorine-releasing agent. Examples 3d and 3e use trichloroisocyanurate as the chlorine-releasing agent.

The compositions of Examples 2 and 3b most effectively delay the release of chlorine, while the composition of Example 3c releases chlorine more quickly than the compositions of the other examples.

What is claimed is:

1. A delayed-release bleaching composition in solid form comprising:

(a) a chlorine-releasing agent; and (b) an amount of a polymeric association product of a polymeric carboxylic acid and a second polymeric compound, which amount is sufficient to delay the release of the chlorine-releasing agent into a liquid environment.

2. A composition of claim 1 wherein the second polymeric compound is a polyether, a polyamine or a polyamide.

3. A composition of claim 2 wherein the second polymeric compound is chosen from poly(ethyl oxazoline), poly(ethylene glycol), poly(acrylamide), poly(vinyl pyrrolidone), copolymers of propylene glycol and ethylene glycol, and copolymers of maleic anhydride and ethylene.

4. A composition of claim 3 wherein the second polymeric compound is poly(ethyl oxazoline).

5. A composition of claim 3 wherein the polycarboxylic acid contains an average of from about 0.7 to about 1.2 free carboxyl groups per 100 molecular weight of said polymeric polycarboxylic acid.

6. A composition of claim 5 wherein the polymeric polycarboxylic acid is poly(methacrylic acid) or poly(acrylic acid).

7. A composition of claim 4 wherein the chlorine-releasing agent is a complex of trichloroisocyanurate and potassium dichloroisocyanurate, wherein the molar ratio of the former to the latter is approximately one to four, potassium dichloroisocyanurate, sodium dichloroisocyanurate, or trichloroisocyanurate.

8. A composition of claim 7 wherein the chlorine-releasing agent is present in an amount which is from about 0.3 to about 3 weight parts per weight part of polymeric association product.

9. A process for the preparation of a delayed-release bleaching composition comprising contacting, in the presence of a solvent, a polymeric polycarboxylic acid, a second polymeric compond, and a chlorine-releasing agent under such conditions that there is formed a composition of claim 1.

10. The process of claim 9 wherein the second polymeric compound is a poly(ethyl oxazoline), a poly(ethylene glycol), or a poly(vinyl pyrrolidone).

11. The process of claim 10 wherein a solvent is employed, and wherein the pH of the mixture of solvent, polycarboxylic acid and second polymeric compound is about 3.5 or higher before the chlorine-releasing agent is added.

12. The process of claim 11 wherein the polycarboxylic acid, the second polymeric compound and the chlorine-releasing agent are contacted at a temperature of from about 0° C. to about 25° C.

13. The process of claim 12 wherein the solvent is water and the pH of the mixture of solvent, polycarboxylic acid and second polymeric compound is from about 6 to about 8.

14. The process of claim 13 wherein the polycarboxylic acid, the second polymeric compound and the chlorine-releasing agent are contacted at a temperature of from about 5° C. to about 10° C.

15. The process of claim 14 wherein the pH of the mixture of solvent, polycarboxylic acid and second polymeric compound is from about 6.8 to about 7.2.

16. A delayed-release bleaching composition in solid form comprising:

(a) a chlorine-releasing agent; and (b) an amount of a polymeric association product of:

(i) a polymeric polycarboxylic acid; and (ii) a poly(ethyl oxazoline) which, when combined in solution or suspension with a polymeric polycarboxylic acid under the proper conditions, will form a polymeric association product;

which amount is sufficient to delay the release of the chlorine-releasing agent into a liquid environment.

17. A composition of claim 16 wherein the chlorine-releasing agent is present in an amount which is from about 0.3 to about 3 weight parts per weight part of polymeric association product.

18. A composition of claim 16 wherein the polymeric polycarboxylic acid is poly(methacrylic acid) or poly(acrylic acid).

19. A composition in solid form comprising:

(a) a polymeric association product of a polymeric polycarboxylic acid and a second polymeric compound selected from the group consisting of polyethers, polyamides, and polyamines; and (b) from about 0.3 to about 3 weight parts of a chlorine-releasing agent per weight parts of polymeric association product.

20. A composition of claim 17 wherein the weight ratio of chlorine-releasing agent to polymeric association product is from about 0.3 to about 1.

* * * * *

UNITED STATES PATENT AND TRADEMARK OFFICE

CERTIFICATE OF CORRECTION

PATENT NO. : 4,725,378

DATED : February 16, 1988

INVENTOR(S) : Dawn T. Krawczak

It is certified that error appears in the above-identified patent and that said Letters Patent is hereby corrected as shown below:

Column 3, line 30 please delete "Tvpically" and insert -- Typically --.

Column 6, line 46 please delete "compond" and insert -- compound --.

Column 6, line 25 please delete "3" and insert -- 4 --.

Column 8, line 12 please delete "parts" and insert -- part --.

Signed and Sealed this

Eleventh Day of October, 1988

*Attest:*

DONALD J. QUIGG

*Attesting Officer*

*Commissioner of Patents and Trademarks*